United States Patent [19]

Tytgat et al.

[11] Patent Number: 4,678,541

[45] Date of Patent: Jul. 7, 1987

[54] BATHS AND PROCESS FOR CHEMICAL POLISHING OF STAINLESS STEEL SURFACES

[75] Inventors: Daniel Tytgat; Pierre Lefèvre, both of Brussels, Belgium

[73] Assignee: Solvay & Cie. (Société Anonyme), Brussels, Belgium

[21] Appl. No.: 869,726

[22] Filed: Jun. 2, 1986

[30] Foreign Application Priority Data

Jun. 3, 1985 [FR] France ..... 85 08440

[51] Int. Cl.[4] ..... C23F 1/00; B44C 1/22

[52] U.S. Cl. ..... 156/664; 134/3; 134/41; 156/903; 252/79.2; 252/79.4

[58] Field of Search ..... 252/79.2, 79.4, 142; 156/664, 903; 134/3, 41

[56] References Cited

U.S. PATENT DOCUMENTS

| | | | |
|---|---|---|---|
| 2,662,814 | 12/1953 | Swihart | 41/42 |
| 3,565,688 | 2/1971 | Costelloe et al. | 134/3 |
| 3,709,824 | 1/1973 | Oda et al. | 252/142 |
| 4,402,759 | 9/1983 | Tytgat | 134/3 |

FOREIGN PATENT DOCUMENTS

| | | |
|---|---|---|
| 0025624 | 3/1981 | European Pat. Off. . |
| 1567825 | 5/1969 | France . |
| 2253103 | 6/1975 | France . |
| 2463820 | 2/1981 | France . |
| 2140038 | 11/1984 | United Kingdom . |

OTHER PUBLICATIONS

Kirk-Othmer, Encyclopedia of Chemical Technology, vol. 12, pp. 25-26, 31-32.

Tegart, The Electrolytic and Chemical Polishing of Metals in Research and Industry, pp. 96-109.

Tegart, Polissage Electrolytique et Chimique des Metaux au Laboratoire et Dans L'Industrie, pp. 122-137, 1960.

*Primary Examiner*—William A. Powell

*Attorney, Agent, or Firm*—Spencer & Frank

[57] ABSTRACT

Baths for chemical polishing of stainless steel surfaces, comprising, in aqueous solution, a mixture of hydrochloric acid, phosphoric acid and nitric acid, ferricyanide complex ions and an additive capable of decomposing nitrous acid.

The baths can be used in particular for chemical polishing of heat exchangers with a very large exchange surface.

10 Claims, No Drawings

BATHS AND PROCESS FOR CHEMICAL POLISHING OF STAINLESS STEEL SURFACES

The present invention relates to the composition of baths for chemical polishing of stainless steel surfaces.

Chemical polishing of metal surfaces constitutes a well-known technique (Polissage électrolytique et chimique des métaux [Electrolytic and chemical polishing of metals], W. J. Mc G. Tegart, Dunod, 1960, p. 122 et seq); it consists in treating the metal surfaces to be polished with baths containing inorganic acids. For chemical polishing of austenitic stainless steels, use is generally made of baths containing a mixture of hydrochloric, phosphoric and nitric acids in aqueous solution (U.S. Pat. No. 2,662,814). To improve the quality of the polish it is usual to include suitable additives in these baths, such as surface-active agents, viscosity regulators and brightening agents. Thus, U.S. Pat. No. 3,709,824 provides a bath composition for chemical polishing of stainles steel surfaces comprising, in aqueous solution, a mixture of phosphoric acid, nitric acid and hydrochloric acid, a viscosity regulator chosen from water-soluble polymers, a surfactant and sulphosalicylic acid as a brightening agent. This known polishing bath has been found to be very effective. However, it has the disadvantage of containing several organic additives, which add to its cost, complicate its use and form a source of contamination when the spent bath is discarded.

These known polishing baths have the characteristic property of attacking the metal at a very high rate. In general, a polishing treatment of a stainless steel surface using such baths cannot exceed a few minutes, without the risk of giving rise to local corrosion. This high rate of action of the known polishing baths is a disadvantage, because it makes them useless for some applications, especially for polishing the inner face of the walls of large vessels, such as boilers, autoclaves or crystallizers. Since the time required to fill and empty such vessels is generally considerably greater than the duration of the optimum chemical polishing treatment, it becomes impossible, in fact, to obtain a uniform polish of the wall, some regions of the latter being inadequately polished, while others are deeply corroded. Furthermore, the high speed of action of the known chemical polishing baths makes control of the polishing difficult. Moreover, these known baths cannot be used for polishing surfaces in contact with which renewal of the bath is difficult, because this results in sudden changes in the local compositions of the bath. They are not suitable for polishing plant in which the surface area to be polished is very large in relation to the space available for the bath, for example heat exchangers with a very large exchange surface.

Document FR-A-2,463,820 disclosed chemical polishing baths comprising a mixture of hydrochloric, nitric and phosphoric acids and a thiourea. It is taught therein that the role of the thiourea is to speed up the rate of chemical polishing.

The purpose of the present invention is to provide a remedy for the abovementioned disadvantages of the known polishing baths, by providing bath compositions for chemical polishing of austenitic stainless steel surfaces, especially of steel alloys containing chromium and nickel, which avoid the use of numerous additives and produce polishes of excellent quality, particularly in the case where the surface area to be polished is very large in relation to the space available for the bath.

Consequently the invention relates to baths for chemical polishing of stainless steel surfaces, comprising, in aqueous solution, a mixture of hydrochloric acid, phosphoric acid and nitric acid; according to the invention, the baths comprise, in the aqueous solution, ferricyanide complex ions and an additive capable of decomposing nitrous acid.

In the baths according to the invention, the ferricyanide complex ions are complex cyanides of general formula $[Fe^{III}(CN)_6]^{3-}$, also called hexacyanoferrates (III) (Encyclopedia of Chemical Technology, Kirk Othmer—John Wiley & Sons, Inc., 1967, Vol. 12, pages 25, 26, 31, 32). There may be present in the aqueous solution in the form of any dissolved compounds such as, for example, hexacyanoferric (III) acid, ammonium ferricyanide and alkali metal and alkaline-earth metal ferricyanides. The preferred compounds are alkali metal ferricyanides, potassium, ferricyanide being especially recommended.

The role of the additive which is capable of decomposing nitrous acid is to decompose at least some of the nitrous acid which is formed during the polishing of a steel surface, the nitrous acid being the result of oxidation of ferrous ions which are released in the bath during the polishing. In principle, the additive may be chosen from any organic and inorganic substances which are capable of decomposing nitrous acid in an aqueous medium; it should be chosen from substances which do not attack the steel to be polished and whose products of reactio with nitrous acid do not attack the steel to be polished. Preference is given to the substances which are soluble in the aqueous solution containing the acid mixture. Sulphamic acid, hydroxylamine, hydrazine, hydrogen peroxide, acetone, urea and primary, secondary and tertiary amines are examples of substances which may be used as the bath additive according to the invention. Nitrogen-containing compounds form a class of substances which are especially advantageous as the bath additive according to the invention; examples of nitrogen-containing substances are urea and its derivatives, especially thiourea and alkyl ureas.

Urea is a preferred nitrogen-containing compound, in accordance with the invention.

In the chemical polishing baths according to the invention, the relative proportions of phosphoric acid, hydrochloric acid, nitric acid and of ferricyanide complex ions are chosen as a function of the nature and of the metal which is treated, of the working temperature of the intended duration of the polishing treatment. The content of the additive which is capable of decomposing nitrous acid depends on various factors, such as the nature of the said additive, the corresponding concentrations of hydrochloric acid, phosphoric acid, nitric acid and of ferricyanide complex ions, the volume of the bath employed, the configuration of the metal surface to be polished and the nature of the metal. It has been found that, all else being equal, the optimum content of additive in the polishing baths according to the invention is proportional to the depth of attack by the bath on the metal and to the relationship between the surface area of the metal to be polished and the volume of the bath employed.

As a general rule, baths according to the invention which are sitable for performing the chemical polishing of austenitic stainless steel surfaces such as, for example, those alloyed with chromium and/or nickel, over a period of between 2 and 24 hours, are those containing between 0.5 and 10, preferably between 1 and 8, moles of hydrochloric acid per liter, between 0.01 and 2.5, preferably between 0.05 and 1.5 mole of phosphoric acid per litre, between 0.001 and 1.5, preferably 0.005 and 1 mole of nitric acid per liter, between 0.3 $10^{-6}$ and 0.3 $10^{-2}$, preferably between 0.3 $10^{-5}$ and 0.3 $10^{-3}$ gram-ion of ferricyanide per liter, and a quantity of additive (expressed in moles per liter of bath) defined by the relationship $$k \cdot \frac{S}{V} \cdot \Delta e$$

where:

S denotes the surface area (expressed in $m^2$) of the metal surface to be polished;

V denotes the volume (expressed in $m^3$) of the bath employed;

e denotes the mean depth (expressed in microns) of attack by the bath, on the metal surface to be polished;

k is a proportionality factor (expressed in mole.m/1.$\mu$m) which is between $10^{-8}$ and $10^{-2}$, preferably between $10^{-7}$ and $10^{-3}$.

Baths which are specially recommended are those in which the overall molarity of the mixture of acids in the aqueous solution is between 1 and 7, and preferably between 2 and 6. Molarities of between 2.5 and 5 are the most advantageous in the majority of applications. Preferred baths are those in which the aqueous solution comprises:

hydrochloric acid in a proportion of 2.5 to 5 moles per liter, phosphoric acid in a proportion of 0.1 to 1 mole per liter, nitric acid in a proportion of 0.01 to 0.5 mole per liter, and potassium ferricyanide in a proportion of 0.1 $10^{-4}$ to 0.2 $10^{-3}$ gram/molecule per liter, and urea, as an additive capable of decomposing nitrous acid, in a quantity, expressed in moles per liter, defined by the abovementioned relationship in which k is between $10^{-7}$ and $10^{-4}$.

The baths according to the invention may optionally contain additives which are usually present in the known baths for chemical polishing of metals, such as, for example, surface-active agents, corrosion inhibitors, viscosity regulators and brightening agents. Where applicable, the baths preferably contain these additives in relative quantities, in relation to the complex cyanide, which do not exceed, respectively:

1:3 by weight, in the case of surface-active agents belonging to the class of alkylpyridinium clorides;

1:1 by weight, in the class of surface-active agents belonging to the class of alkylphenols; and 1:1 in moles, in the case of thickeners chosen from cellulose ethers.

Preferred baths are those which are substantially free from alkylpyridinium chloride, alkylphenol and cellulose ether.

A major advantage of the polishing baths according to the invention lies in their suitability after adjustment of the relative concentrations of their components, for producing polishes at a moderate speed of action, which may be spread over several hours, so as to permit uniform polishing of large surfaces or of surfaces to which access is difficult. They are especially highly suitable for polishing metal surfaces whose area is very large when compared to the space available for the bath. By way of example, they find an advantageous application in the polishing of metal surfaces whose area (expressed in $m^2$) is equal to at least 3 times, and which is preferably more than 8 times the volume (expressed in $m^3$) of the polishing bath which is in contact with it, such as, for example, heat exchangers with a very large exchange surface. The performance of the baths according to the invention is not restricted by a maximum value of the relationship between the surface area to be polished and the volume of the bath employed, it being possible for this relationship, expressed in $m^{-1}$ to attain, for example, 20 and high values.

The baths according to the invention are suitable for polishing any austenitic stainless steel surfaces. They find an especially advantageous application in the polishing of austenitic stainless steels alloyed with chromium and with nickel, particularly those containing between 12 and 26% of chromium and between 6 and 22% of nickel, such as 18/8 and 18/10 steels, for example.

Consequently, the invention also relates to a process for polishing a stainless steel surface, according to which the surface is placed in contact with a chemical polishing bath in accordance with the invention.

In the process according to the invention, a previously manufactured bath may be employed, with which the metal surface to be polished is then placed in contact.

In accordance with a particular embodiment of the process according to the invention, after the metal surface has been placed in contact with the bath a further addition is made of nitric acid and of the additive capable of decomposing nitrous acid. As an alternative, several successive additions, or a continuous introduction of nitric acid and of the said additive may be performed, as the polishing progresses.

In a preferred embodiment of the process according to the invention, the bath is produced in situ in contact with the metal surface to be polished. For this purpose, the metal surface is first placed in contact with an aqueous solution containing hydrochloric acid, phosphoric acid, nitric acid and the additive capable of decomposing nitrous acid, and then the ferricyanide complex ions are added to the solution while it is in contact with the metal surface. In the use of this embodiment of the process according to the invention it is advantageous to wait for the metal surface to have undergone a substantial attack by the acid solution before adding the ferricyanide ions to it; in practice it is advantageously possible to adjust the time period between the time when the surface to be polished is placed in contact with the aqueous solution and the time when the ferricyanide complex ions are added to the said solution, so that it corresponds to an attack by the solution on the surface to a depth of between 0.1 and 6 microns, preferably between 0.5 and 4 microns. Alternatively, after the ferricyanide complex ions have been added to the solution, further additions of nitric acid and of additive capable of decomposing nitrous acid can be carried out, as stated earlier.

In the process according to the invention, the contact time of the surface to be polished with the bath needs to be sufficient to produce an effective polishing of the surface; however, it cannot exceed a critical value beyond which there is a danger of the appearance of localized corrosion on the surface, unless a further addition of nitric acid and of additive capable of decomposing nitrous acid is carried out in accordance with the particular embodiment of the process, described above. The optimum contact time between the surface to be polished and the bath, or the amount of the further addition of nitric acid and of additive capable of decomposing nitrous acid, depend on numerous factors such as the steel composition of the surface to be polished, the configuration and initial roughness of the latter, the bath composition, the working temperature, possible turbulence of the bath in contact with the surface, and the relationship between the surface area of metal to be polished and the volume of the bath employed; it has to be determined in each particular case by means of routine laboratory tests.

The invention will be explained in detail with the aid of the examples whose description will follow.

Example 1

A sheet 20 $m^2$ in area, made of ASTM 316L grade stainless steel (steel alloy containing chromium (16.0 to 18.0%), nickel (10.0 to 14.0%) and molybdenum (2.0 to 3.0%)) was immersed in 1 $m^3$ of a bath containing, per liter:

2.7 moles of hydrochloric acid,
0.3 mole of phosphoric acid,
0.06 mole of nitric acid, and
30 mg of potassium ferricyanide.

Immediately after immersing the sheet in the bath, continuous addition of an aqueous solution of nitric acid was commenced, at a rate of 0.50 mole of nitric acid per hour. Furthermore, two successive additions of 2 kg of urea were made, after 4 hours' and 6 hours' treatment respectively. After 8 hours' treatment, measurement showed the mean depth of attack by the bath on the sheet to be 108 microns. At this time, the sheet was taken out of the bath, washed with demineralized water and dried. Its appearance waas smooth and shiny.

Example 2

A sheet 427 $cm^2$ is area, made of ASTM 304L grade stainless steel (steel alloy containing chromium (18.0 to 20.0%) and nickel (8.0 to 12.0%)) was immersed in 935 $cm^3$ of a bath at 55° C. containing, per liter:

4.5 moles of hydrochloric acid,
0.6 mole of phosphoric acid,
0.03 mole of nitric acid, and
100 mg of potassium ferricyanide.

0.03 g of niric acid per liter of bath and 1.4 g of urea per liter of bath were added at 90 minute intervals. After 7 hours treatment, measurement showed the mean depth of attack by the bath on the metal to be 117 microns. At this time, the sheet was taken out of the bath, washed with water and dried. Its appearance was smooth and shiny.

What is claimed is:

1. Baths for chemical polishing of stainless steel surfaces, comprising, in aqueous solution, a mixture of hydrochloric acid, phosphoric acid, and nitric acid, which are characterized in that they comprise, in the aqueous solution, ferricyanide complex ions and an additive capable of decomposing nitrous acid.

2. Baths according to claim 1, characterized in that the ferricyanide complex ions are present in the form of potassium ferricyanide and the additive is chosen from urea and urea derivatives.

3. Baths according to claim 1, characterized in that the aqueous solution comprises between 0.5 and 10 moles of hydrochloric acid per liter,
between 0.01 and 2.5 moles of phosphoric acid per liter,
between 0.001 and 1.5 mole of nitric acid per liter,
between 0.3 $10^{-6}$ and 0.3 $10^{-2}$ gram-ion of ferricyanide per liter, and
a quantity of additive (expressed in moles per liter of bath) defined by the relationship $$k \cdot \frac{S}{V} \cdot \Delta e$$

in which:

S denotes the area (expressed in $m^2$) of the metal surface to be polished;
V denotes the volume (expressed in $m^3$) of the bath employed;
e denotes the mean depth (expressed in microns) of attack by the bath on the metal surface to be polished; and
k is a proportionality factor (expressed in mole.m/1.μm) which is between $10^{-8}$ and $10^{-2}$.

4. Baths according to claim 3, characterized in that the aqueous solution comprises between 1 and 8 moles of hydrochloric acid per liter,
between 0.05 and 1.5 mole of phosphoric acid per liter,
between 0.005 and 1 mole of nitric acid per liter,
between 0.3 $10^{-5}$ and 0.3 $10^{-3}$ gram-ion of ferricyanide per liter, and
a quantity of additive (expressed in moles per liter of bath) defined by the abovementioned relationship, in which k is between $10^{-7}$ and $10^{-3}$.

5. Baths according to claim 4, characterized in that the aqueous solution comprises:

between 2.5 and 5 moles of hydrochloric acid per liter,
between 0.1 and 1 mole of phosphoric acid per liter,
between 0.01 and 0.5 mole of nitric acid per liter,
between 0.1 $10^{-4}$ and 0.2 $10^{-3}$ gram-molecule of potassium ferricyanide per liter, and
as an additive capable of decomposing nitrous acid, urea in a quantity, expressed in moles per liter, defined by the abovementioned relationship in which k is between $10^{-7}$ and $10^{-4}$.

6. Baths according to claim 1, characterized in that the overall molarity of the mixture of acids in the aqueous solution is between 2 and 6.

7. Process for polishing a stainless steel surface, according to which the surface is placed in contact with a chemical polishing bath, characterized in that a bath according to claim 1 is employed.

8. Process according to claim 7, characterized in that the surface is first placed in contact with an aqueous solution containing hydrochloric acid, phosphoric acid, nitric acid and an additive capable of decomposing nitrous acid, and then ferricyanide complex ions are added to the solution.

9. Process according to claim 8, characterized in that the time period between the time when the surface is placed in contact with the solution and the time when the ferricyanide complex ions are added to the solution is adjusted so that it corresponds to an attack by the solution on the surface to a depth of between 0.1 and 6 microns.

10. Process according to claim 7, characterized in that, while the steel surface is in contact with the bath, supplementary nitric acid and additive capable of decomposing nitrous acid are added to the latter.

* * * * *